US008061958B2

(12) United States Patent
Abeta et al.

(10) Patent No.: US 8,061,958 B2
(45) Date of Patent: Nov. 22, 2011

(54) METHOD OF ADJUSTING THE DEVIATIONS OF PLATE MATERIAL OF A RECTANGULAR SHAPE AND THE EQUIPMENT THEREFOR

(75) Inventors: Hiroshi Abeta, Toyokawa (JP); Hiroyuki Itakura, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 457 days.

(21) Appl. No.: 12/353,738

(22) Filed: Jan. 14, 2009

(65) Prior Publication Data

US 2009/0185889 A1 Jul. 23, 2009

(30) Foreign Application Priority Data

Jan. 21, 2008 (JP) ..... 2008-009964

(51) Int. Cl.
*B27B 31/04* (2006.01)

(52) U.S. Cl. ..... 414/781; 700/228

(58) Field of Classification Search ..... 248/913; 269/153, 73; 271/236, 250; 33/568; 414/677, 414/730, 731, 749.3, 781, 783; 700/228, 700/230; 83/279, 412
See application file for complete search history.

(56) References Cited

U.S. PATENT DOCUMENTS 4,297,927 A * 11/1981 Kuroda ..... 83/36
4,826,421 A * 5/1989 Asano et al. ..... 425/403.1
5,028,202 A * 7/1991 Katada et al. ..... 414/783
5,290,027 A * 3/1994 Clanton et al. ..... 271/227
5,868,549 A * 2/1999 Lee et al. ..... 414/791.6
6,719,287 B2 * 4/2004 Henn ..... 271/226
2009/0104300 A1 * 4/2009 Hiroshi et al. ..... 425/110
2009/0142433 A1 * 6/2009 Abeta et al. ..... 425/112
2009/0185889 A1 * 7/2009 Abeta et al. ..... 414/754

FOREIGN PATENT DOCUMENTS

JP 56043149 A * 4/1981
JP 06232240 A * 8/1994
JP 06247594 A * 9/1994
JP 2003-312901 11/2003

* cited by examiner

*Primary Examiner* — Gregory Adams
(74) *Attorney, Agent, or Firm* — Finnegan, Henderson, Farabow, Garrett & Dunner, L.L.P.

(57) ABSTRACT

A method of adjusting any deviations of plate material in the lateral and longitudinal directions including: measuring positions on a first long side of a plate, rotating the plate thereby removing the difference between first and second points; measuring a position on a second long side of the plate, calculating the position of the center line in the lateral direction based on first, second and third points; adjusting the deviation of the positions by moving the plate in the lateral direction and matching the center line with the targeted center line; measuring a fourth position on a short side of the plate and calculating the position of the center line based on the position of the fourth point; and adjusting the deviation by moving the plate in a longitudinal direction and matching the center line in the longitudinal direction with the targeted center line.

3 Claims, 9 Drawing Sheets

METHOD OF ADJUSTING THE DEVIATIONS OF PLATE MATERIAL OF A RECTANGULAR SHAPE AND THE EQUIPMENT THEREFOR

FIELD OF THE INVENTION

This invention relates to a method of adjusting the deviations of plate material of a rectangular shape (hereafter "plate material") and the equipment therefor. More particularly, it relates to a method of adjusting the deviations of plate materials and the equipment therefor, wherein the adjusting deviations of the plate materials is carried out at one location, so that the plate material that is arbitrarily placed in a horizontal position can be delivered to a forming machine after its deviations in inclination, positioning, etc., from its desired state, are adjusted.

BACKGROUND OF THE INVENTION

Conventionally, the equipment that typically is used in this field of technology is equipment that delivers the plate materials to a forming machine. It comprises:

1. a first measuring means that measures the position of any one point on the edge of a first long side of the plate material that is lifted;
2. a second measuring means that measures the positions of any two points on the edge of a second or opposite long side of the plate material;
3. a first calculating means that calculates the difference in the positions of the two points on the second or opposite long side of the plate material in the lateral direction thereof, based on the results of the measurements of the positions of the two points as measured by the second measuring means;
4. an angle-adjusting means that adjusts the deviation of the plate material from the desired state in terms of the angle formed between the plate material and its desired state, by rotating the plate material on the horizontal plane so as to remove the difference that is calculated by the first calculating means;
5. a second calculating means that calculates the position that is a midpoint between one of the two points on the edge of the second or opposite long side of the plate material and one point on the edge of the first long side of the plate material, based on the results as measured by the second measuring means and the first measuring means;
6. a first adjusting means that adjusts the deviation of the plate material in the lateral direction by moving the plate material in the lateral direction and substantially matching the position of the midpoint calculated by the second calculating means with any point on the extension of the center line of the forming machine, which center line is the center line in the lateral direction of the plate material;
7. a third measuring means that measures the position of any one point on the edge of a first short side of the plate material;
8. a fourth measuring means that measures the position of any one point on the edge of the second or opposite short side of the plate material for which the deviation in the lateral direction is adjusted;
9. a third calculating means that calculates the position that is a midpoint between the two points as measured by the third and fourth measuring means; and
10. a second adjusting means that adjusts the deviation in the longitudinal direction of the plate material, by moving the plate material in the longitudinal direction and substantially matching the midpoint calculated by the third calculating means with the center line of the forming machine, which center line is parallel to the center line extending in the longitudinal direction of the plate material. (See Patent Document 1.)

The equipment that delivers the plate material to a forming machine, thus constituted, measures each position of one point on the edge of the first long side of the plate material and the positions of two points on the edge of the second or opposite long side of the plate material, adjusts any deviation in the angle of the plate material by horizontally rotating it so as to remove the difference in the positions of these two points, and then, after calculating the midpoint between one of the two points on the second or opposite long side of the plate material and the point on the first long side of the plate material, and moving the plate material in the lateral direction and substantially matching the position of the midpoint with the extension of the center line of the forming machine, which center line is parallel to the center line extending in the lateral direction of the plate material, and then adjusts the deviation of the position of the plate material in the lateral direction;

Then, the equipment that delivers the plate material to the forming machine measures each of the positions of one point on the edge of a first short side of the plate material and the position of any one point on the edge of a second or the opposite short side, calculates the position of the midpoint of these two points, and then moves the plate material in the longitudinal direction, substantially matches the position of the midpoint with the center line of the forming machine, which center line is parallel to the center line extending in the longitudinal direction of the plate material and adjusts the deviation of the position of the plate material in the longitudinal direction.

See Patent document 1: Publication of laid-open patent application, No. 2003-312901.

However, the conventional equipment that delivers the plate material to the forming machine thus constituted has problems. For example, it requires an apparatus that moves the plate material and an apparatus that delivers it, in addition to an apparatus that adjusts the deviation of the plate material, because the operations of adjusting the deviations in the lateral direction of the plate material and in the longitudinal direction of the plate material are carried out in different locations. Thus the equipment becomes larger, its manufacturing cost is higher, and the equipment needs a larger space to be installed.

SUMMARY OF THE INVENTION

Problems to be Solved by the Invention

In view of the problems stated above, the present invention aims to provide a method of adjusting the deviations of the plate material, wherein the method can adjust the deviations in the lateral direction and the longitudinal direction at one location. Also, the present invention aims to provide the equipment for the method.

Means to Solve the Problems

To solve the problems stated above, the method of adjusting the deviations of the plate material of the present invention adjusts at one location the deviations of the inclination, positioning, etc., from the desired state, of the plate material that is arbitrarily placed in a horizontal position before the plate material is delivered to the forming machine, the method comprising:

1. a step to measure each of the positions of the first and second points of an arbitrary choice on the edge of a first long side of the plate material;
2. a step to adjust the deviation of the inclination of the plate material by rotating the plate material on the horizontal plane so as to remove the difference in the position of the plate material in the lateral direction between the first and second points, based on the results of the measurements of the first and second points;
3. a step to measure the position of a third point of an arbitrary choice on the edge of a second or opposite long side of the plate material, for which the deviation of the inclination has been adjusted;
4. a step to calculate the position of the center line in the lateral direction of the plate material for which the deviation of the inclination has been adjusted, based on the results of the measurements of the positions of the first, second, and third points;
5. a step to adjust the deviation of the positions in the lateral direction by moving the plate material in the lateral direction and substantially matching the center line in the lateral direction of the plate material with the targeted center line;
6. a step to measure a fourth point of an arbitrary choice on the edge of the short side of the plate material for which the deviation of the plate material in the lateral direction has been adjusted;
7. a step to calculate the position of the center line in the longitudinal direction of the plate material, based on the results of the measurements of the position of the fourth point; and
8. a step to adjust the deviation in the longitudinal direction of the plate material by moving the plate material in the longitudinal direction and substantially matching the center line extending in the longitudinal direction of the plate material with the targeted center line, based on the results of the calculation of the position of the center line in the longitudinal direction.

DETAILED DESCRIPTION OF THE INVENTION

The Effect of the Invention

The present invention renders equipment that delivers plate material unnecessary, because in the method of the present invention the deviation in the lateral direction of the plate material and the deviation in the longitudinal direction of the plate material are adjusted at one location. Thus the present invention produces various advantageous practical effects. For example, the size of the equipment that adjusts the deviations of the position of plate material can be made smaller than is conventional equipment of this sort.

The Best Mode of Carrying Out the Invention

Figure 1:
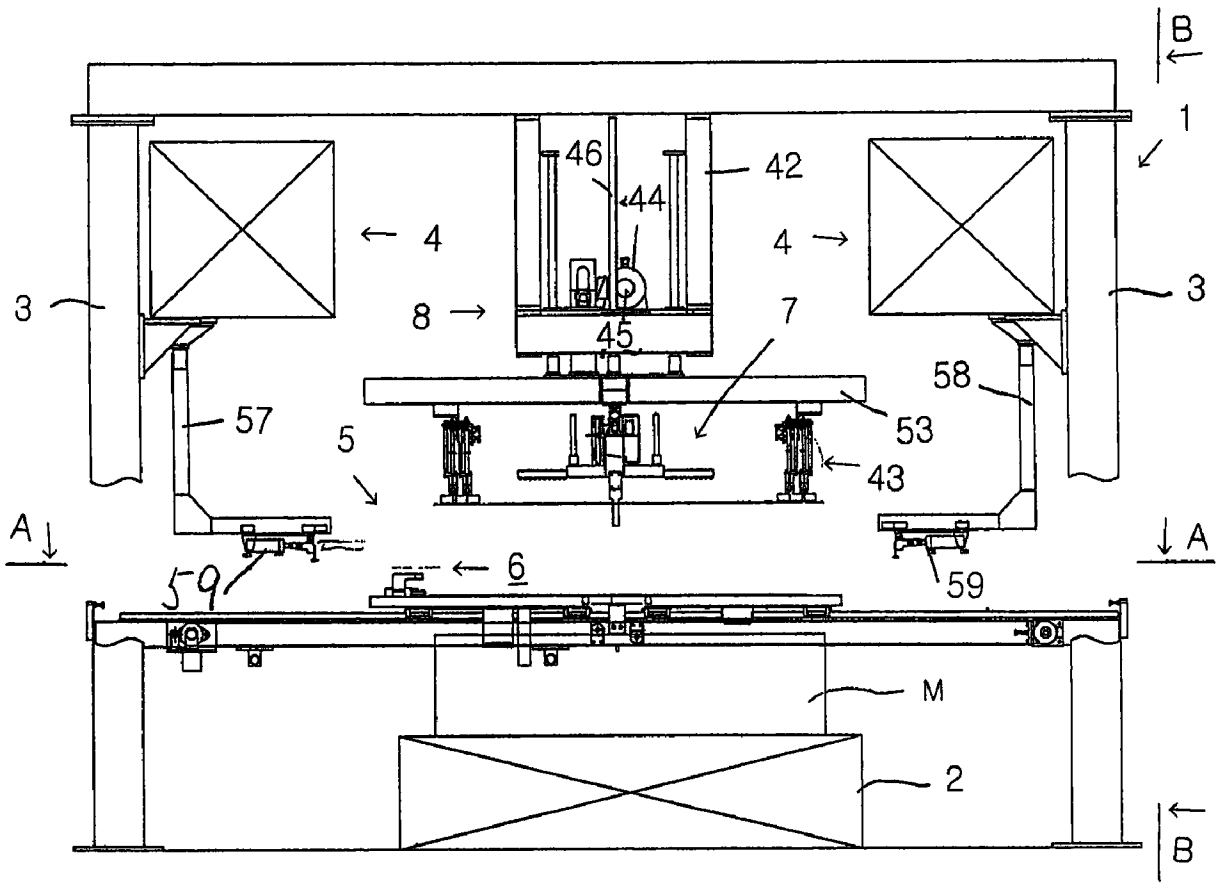
FIG. 1 shows a front view of the equipment that delivers the plate material to the forming machine in one embodiment of the present invention (a part of the equipment is not shown).
Figure 2:
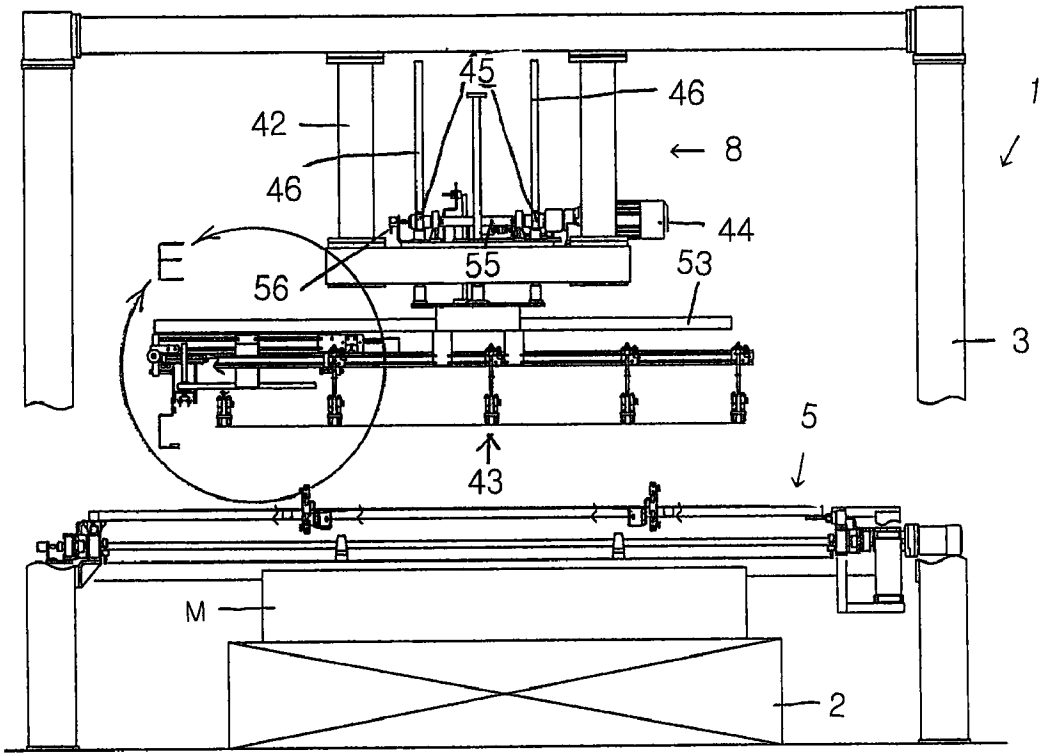
FIG. 2 shows a view seen from the direction of the arrows B-B in FIG. 1.

Below an embodiment of the equipment that delivers the plate material to the forming machine of the present invention is explained in detail, based on FIGS. 1-11. As shown in FIGS. 1 and 2, the equipment that delivers the plate material of the present invention comprises a gate-type frame 1 installed on the floor. Within and in the middle of the gate-type frame 1 is installed on the floor a conventional elevating means 2 that lifts and lowers a plurality of the piled-up plate materials M of the pre-determined size. Also, the delivery means 4 that deliver to the forming machine (not shown) the plate materials M that have their positional deviations adjusted are disposed at the position of the upper parts of the supports 3, 3 of the gate-type frame 1. The delivery means 4 are equipped with clamping means 59, 59, for the plate material M. Each of the clamping means are attached to two respective frames, i.e., a left frame 57 and a right frame 58. The left frame 57 and the right frame 58 can approach or draw apart from each other.

Within the gate-type frame 1, equipment is disposed that adjusts at one location the deviations in inclination, positioning, etc., from the desired state, of the plate material M that is arbitrarily placed in a horizontal position. The equipment that adjusts the deviations of the plate material M comprises a table mechanism 5 that can place one plate material M on it and through which the plate material M can be lifted and lowered; a first adjusting means 6 attached to the table mechanism 5, which means adjusts the deviation in the lateral direction of the plate material M that is placed on the table mechanism 5; a second adjusting means 7 that is disposed above the first adjusting means 6, and that can be lifted and lowered, and that adjusts the deviation in the longitudinal direction of the plate material M for which the deviation in the lateral direction has been adjusted; and a hoisting mechanism 8 that lifts and lowers the second adjusting means 7.

Figure 3:
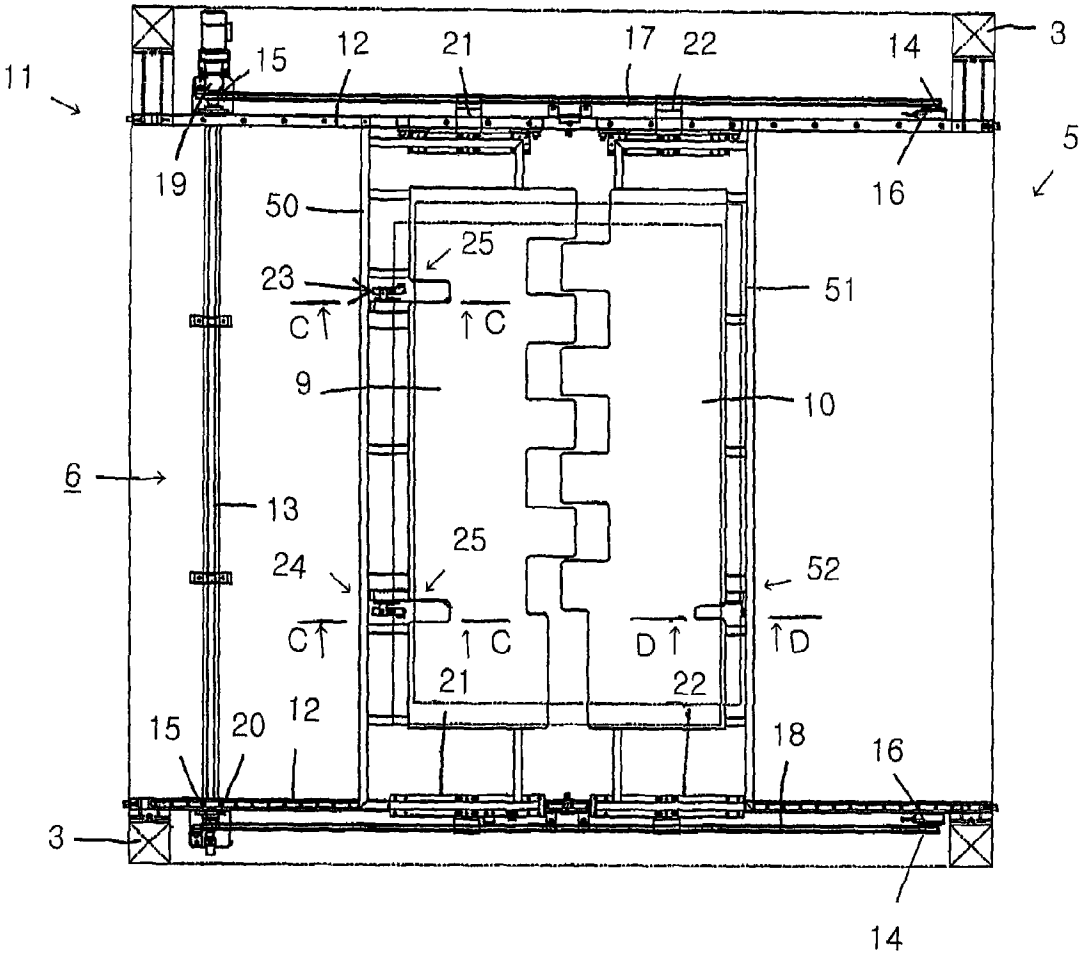
FIG. 3 shows a view seen from the direction of the arrows A-A in FIG. 1.

Also, as shown in FIG. 3, the table mechanism 5 comprises two plates, i.e., the left and right plates 9, 10, and a closing and opening mechanism 11 that makes these two plates, i.e., the left and right plates 9, 10 come closer to or draw apart from each other. Each of the two plates, i.e., the left and right plates 9, 10, have a shape forming complementary indentations and projections on their opposing edges. That shape enables the opposing edge of either the left or right plate to enter the indented portions of the other plate. The shape forms a space between the front edges of the left and right plates when the two plates come closer, into which space a bracket 39 of the fourth measuring means 54, described below, can enter. Further, the left and right plates 9, 10 are movably supported by two linear guide mechanisms 12, 12 via support frames 50, 51. The two linear guide mechanisms 12, 12, bridge respectively the forward pillars and rear pillars of the supports 3, 3 of the gate-type frame 1 and run in the right-to-left direction.

Also, as shown in FIG. 3, the closing and opening mechanism 11 comprises a rotatable shaft 13 that is disposed close to the left-hand side pillars of the supports 3,3, and is directed in a backward-forward direction and that is rotatably supported by the bearings (not shown) of the linear guide mechanisms 12, 12, fixed shafts 14, 14, installed at the ends of the respective linear guide mechanisms 12, 12, and at the sides opposite the rotatable shaft 13, four belt pulleys 15, 15, 16, 16 that are connected to the ends of the rotatable shaft 13 and the fixed shafts 14, 14, two endless belts 17, 18 that are each mounted on each pair of the left and right belt pulleys 15, 16 positioned at the front and rear parts of the mechanism 11, an electric motor 19 with a decelerator that has its output axis connected to the back end of the rotatable shaft 13 and that is fastened to the gate-type frame 1, and a rotary encoder 20 that is connected to the front end of the rotatable shaft 13. Also, to the upper and lower belts of the two endless belts 17, 18, are connected the two plates, i.e., the left and right plates 9, 10 respectively, via two pairs of connecting members 21, 22, whereby the two plates, i.e., the left and right plates 9, 10, approach or draw apart from each other by the positive and reverse rotations of the electric motor 19.

Also, as shown in FIG. 3, the first adjusting means 6 comprises:

1. a first measuring means 23 and a second measuring means 24 that are attached to the support frames 50 and that measure respectively the positions of a first and a second point of an arbitrary choice on the edge of the long side of the plate material M;
2. a first calculating means that calculates the difference between the positions of the first and the second point in the lateral direction of the plate material M, based on the result of measurements of the positions of the first and second points;
3. a first means of traction 25 that is attached to the support frame 50 and that pulls the plate material M, based on the result of the calculation of the first calculating means;
4. a third measuring means 52 that is attached to the support frame 51 and that measures a third point of an arbitrary choice on the edge of the second or opposite long side of the plate material M; and
5. a second calculating means that calculates the position of the center line in the lateral direction of the plate material M for which the deviation in the inclination from the desired state has been adjusted, based on the results of the measurements of the positions of the first, second, and third points.

Figure 4:
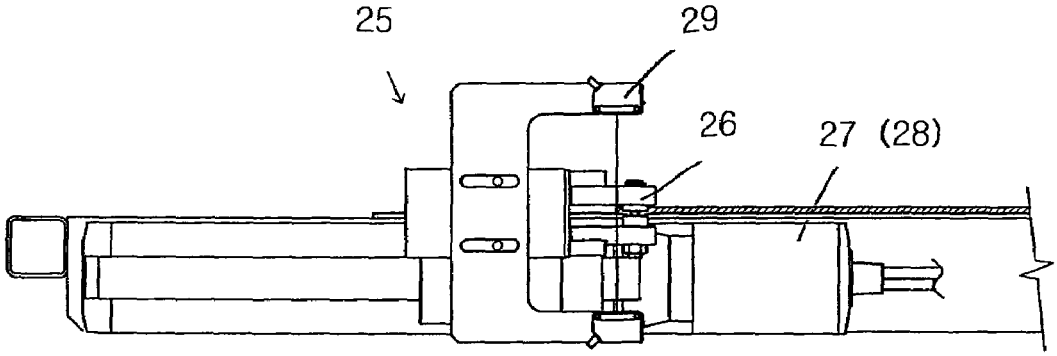
FIG. 4 shows an enlarged view seen from the direction of the arrows C-C in FIG. 3.

Also, as shown in FIG. 4, the first means of traction 25 comprises a clamping mechanism 26 that clamps the edge of the long side of the plate material M and two electrically-driven actuators 27, 28, that are placed apart from each other in a backward-forward direction with the appropriate distance between them (see FIG. 4).

Also, the two electrically-driven actuators 27, 28 are each equipped with a photosensor 29 that sandwiches the clamping mechanism 26 from above and below. Also, the two electrically-driven actuators 27, 28, are each equipped with a rotary encoder (not shown) that measures the distance of the expansion and contraction of the actuators. The encoders each constitute the first and second measuring means 23, 24.

Figure 5:
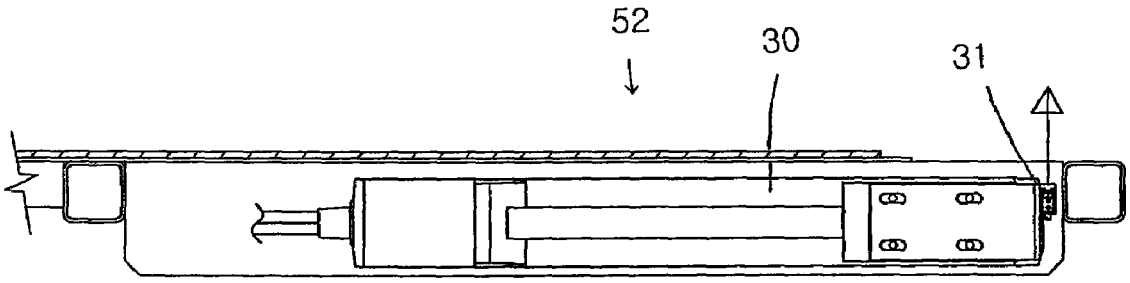
FIG. 5 shows an enlarged view seen from the direction of the arrows D-D in FIG. 3.

Also, as shown in FIG. 5, the third measuring means 52 comprises an electrically driven actuator 30, a reflective photosensor 31 attached to the electrically driven actuator 30, and a rotary encoder (not shown) that is attached to the electrically driven actuator 30 and that detects the distance of the expansion and contraction of the actuator 30. The photosensor 31 moves in the horizontal (right-to-left) direction by the expansion and contraction of the electrically driven actuator 30.

Figure 6:
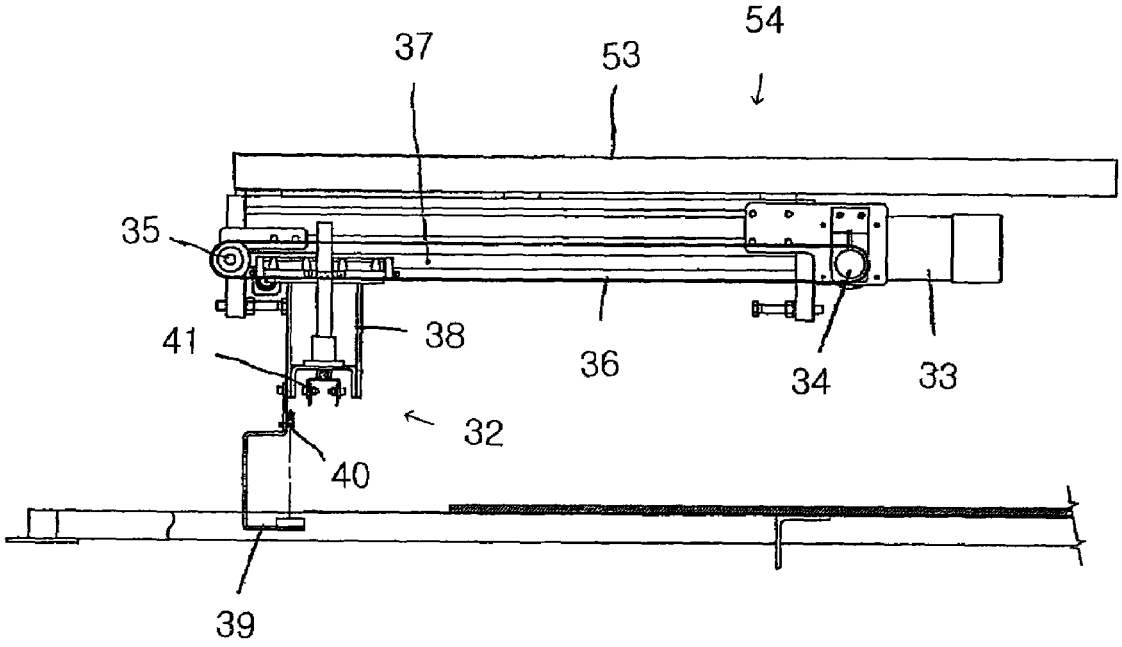
FIG. 6 shows an enlarged view of E in FIG. 2.

Also, as shown in FIG. 6, the second adjusting means 7 comprises 1. a hoisting frame 53 having a shape of a surface plate, disposed directly below the hoisting means 8 that is disposed above the table mechanism 5, which hoisting frame 53 is movable upward and downward,
2. a fourth measuring means 54 that is attached to the lower surface of the hoisting frame 53 and that measures the position of a fourth point of an arbitrary choice on the edge of the short side of the plate material M, for which the deviation in the lateral direction has been adjusted,
3. a third calculating means that calculates the position of the center line in the longitudinal direction of the plate material M, based on the result of the measurement of the position of the fourth point, and
4. a second means of traction 32 that pulls the position of the center line in the longitudinal direction of the plate material M to the targeted center line, based on the result of the calculation carried out by the third calculating means.

Also, as shown in FIG. 6, the fourth measuring means 54 comprises:

1. an electric motor 33 with a decelerator, which motor is disposed close to the center of and below the hoisting frame 53,
2. a belt pulley 34 that is connected to the output shaft of the electric motor 33 with the decelerator
3. a belt pulley 35 that is connected to the shaft below the hoisting frame 53, and that is disposed, opposite to the belt pulley 34, at the left-side end of the hoisting frame 53,
4. an endless belt 36 that links a belt pulley 34 and a belt pulley 35,
5. a linear guide 37 disposed in the right-to-left direction (in the case of FIG. 1, in the backward-forward direction) below the hoisting frame 53,
6. a traveling frame 38 suspended along the linear guide 37, movable along it and connected to the lower belt of the endless belt 36,
7. a photosensor 40, attached to the lower edge of the traveling frame 38 via a bracket 39, and
8. a rotary encoder (not shown) attached to the electric motor 33.

Also, the traveling frame 38 that is equipped with a holding member 41 having a shape of a saw blade, which member is lifted and lowered by an actuator (not shown), constitutes the second means of traction 32. Also, the first, second, and third calculating means comprise a computer (not shown).

Also, as shown in FIGS. 1 and 2, the hoisting mechanism 8 is installed on the supporting member 42 disposed directly above the elevating means 2. The support member 42 is attached to the lower surface of the ceiling frame of the gate-type frame 1. The hoisting mechanism 8 comprises a clamping means 43 that can clamp the peripheral part of the plate material M and that is attached to the lower surface of the hoisting frame 53, an electric motor 44 with a decelerator, which motor is disposed on the support member 42, two pinions 45 that are connected to the main output-shaft of the electric motor 44 with the decelerator via connecting shaft 55 and that are placed apart from each other at an appropriate distance between them, and two racks 46 that each engage each of the two pinions 45 and that are disposed in a standing position on the hoisting frame 53. A rotary encoder 56 is connected to the output shaft of the electric motor 44.

Next, explained are the procedures of delivering to the forming machine the plate material that is arbitrarily placed in a horizontal position after its deviations are adjusted by the equipment that delivers the plate material to the forming machine of the present invention. First, two plates, i.e., the left and right plates 9, 10, are separated from each other by the electric motor 19 with the decelerator of the table mechanism 5 being reversely rotated. Then a plurality of the piled-up plate material M is elevated by the elevating means 2 that moves upward until the uppermost plate material M of the group of the plate materials M reaches a predetermined height below the left and right plates 9, 10.

Next, the plate material M that is at the uppermost position of the group of the plate materials M is clamped by the clamping means 43, after the clamping means 43 is lowered via the hoisting frame 53 by the electric motor 44 with the decelerator of the hoisting mechanism 8 being reversely rotated, followed by hoisting the plate material M via the clamping means 43 by the electric motor 44 with the decelerator being rotated in a positive direction. Then the elevating means 2 elevates stepwise the group of the plate materials M so that the uppermost plate material M of the group of the plate materials M reaches in turn the predetermined height below the left and right plates 9, 10.

Figure 7:
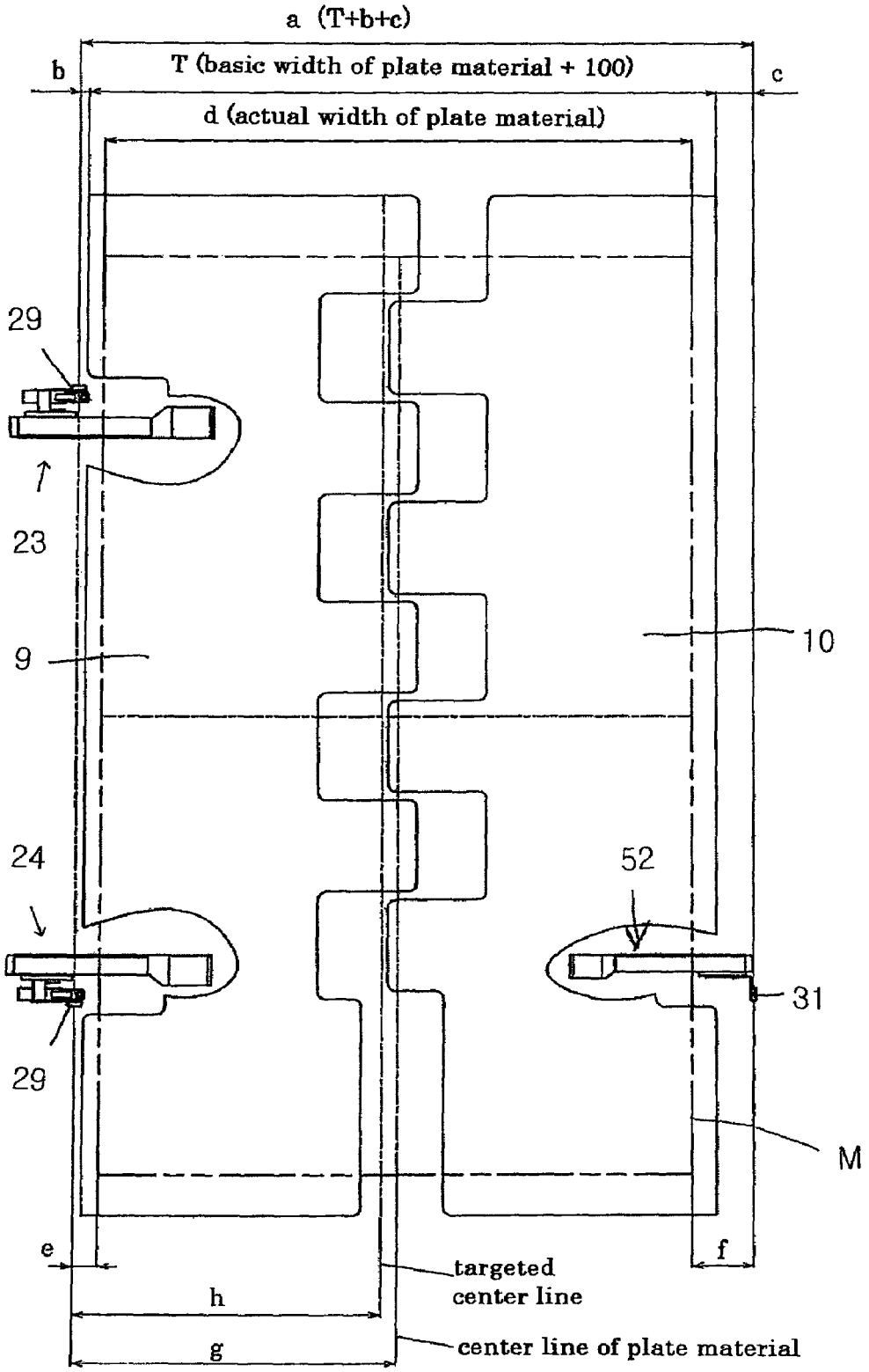
FIG. 7 shows an enlarged view of the main part of FIG. 3.
Figure 8:
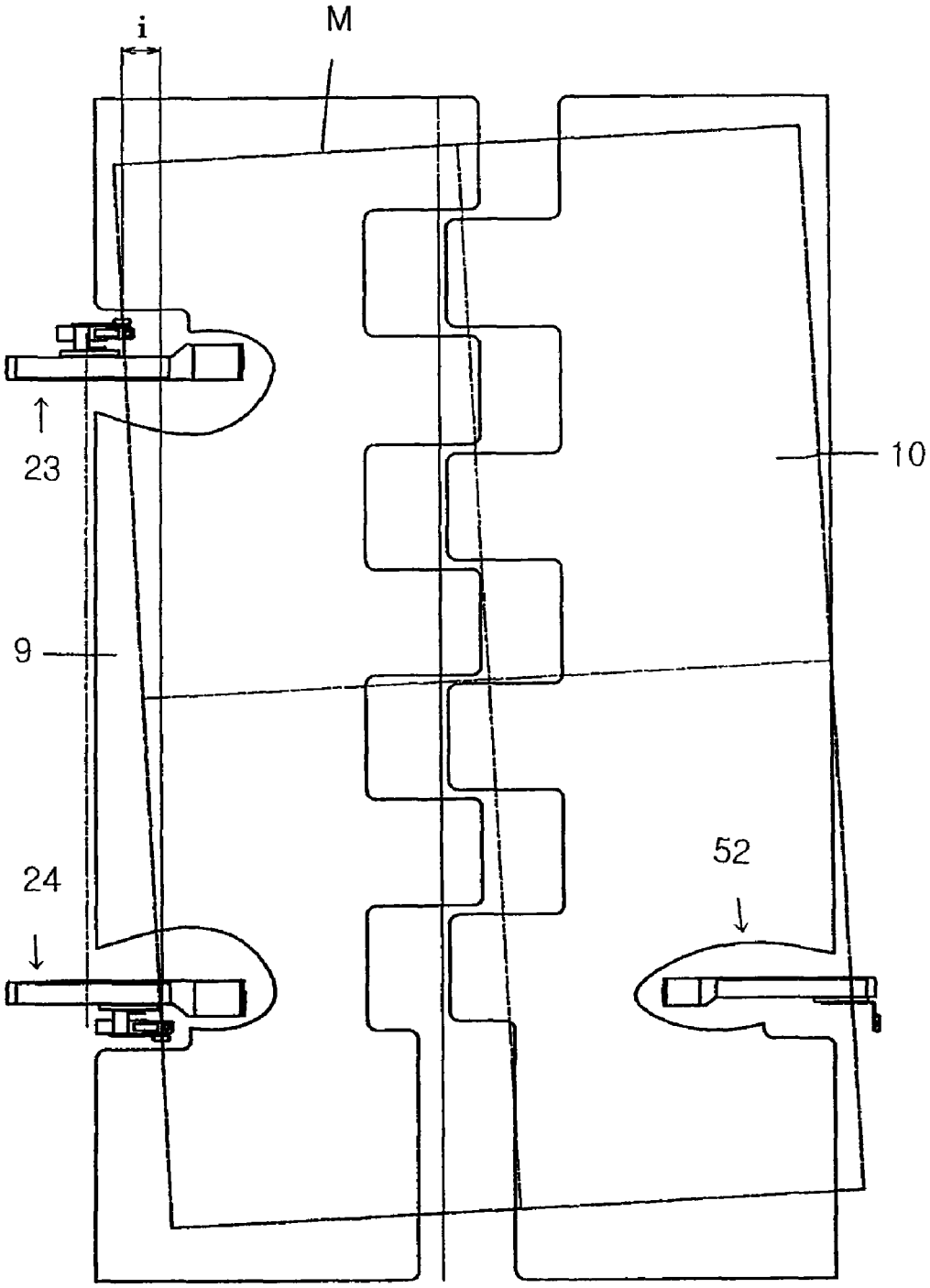
FIG. 8 shows an illustrative view of one embodiment of the table mechanism of FIG. 7.

Next, the width in the right-to-left direction of the two plates., i.e., the left and right plates 9, 10, is adjusted to the predetermined value T, as shown in FIG. 7, by having the two plates, i.e., the left and right plates 9, 10, come closer to each other by the electric motor 19 with the decelerator of the table mechanism 5 being rotated in a positive direction. The predetermined value T, the value obtained for the width of the plate material M in the lateral direction plus 100 mm, which is provided for a tolerance needed in the adjustment of the deviation of the position, gives a length formed between the farthest left end and farthest right end of the plates 9, 10, when the two plates., i.e., the left and right plates 9, 10, approach each other (see FIG. 7).

Next, the plate material M is lowered by the electric motor 44 being reversely rotated, and then placed on the two plates., i.e., the left and right plates 9, 10, by releasing the clamping of the plate material M by the clamping means 43, followed by hoisting the clamping means 43 by the electric motor 44 being rotated in a positive direction. Then a computer calculates the width i of FIG. 8, based on the measurements of the positions of the first point and second point of an arbitrary choice on the edge of the long side of the plate material M as measured by the first measuring means 23 and the second measuring means 24.

Figure 9:
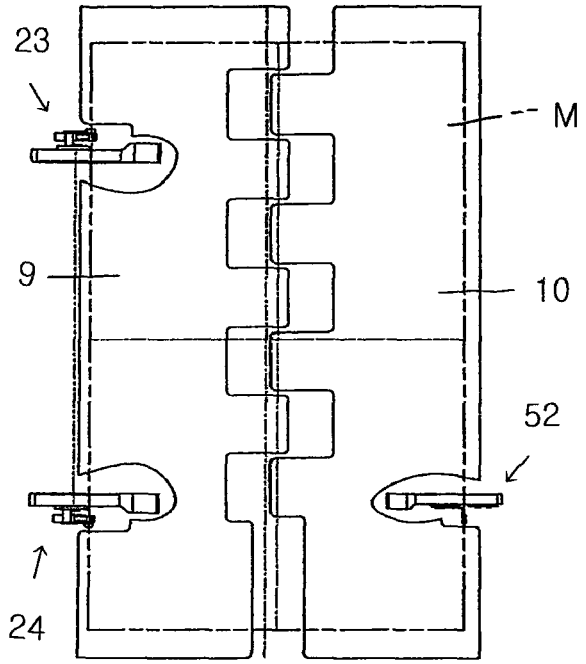
FIG. 9 shows an illustrative view of one embodiment of the table mechanism of FIG. 7.

Then after the clamping means 26 of the first means of traction 25 clamps the edge of the long side of the plate material M, an electrically driven actuator 28 of the first means of traction 25 in the front part is operated and contracts so as to remove the deviation (width i) by the instructions of the computer, and the plate material M, as shown in FIG. 9, is adjusted so that its center line extending in the lateral direction comes parallel to the targeted center line of the gate-type frame 1, followed by the measurement by the third measuring means 52 of the position of a third point of an arbitrary choice on the edge of the long side of the plate material M on the right-hand side.

Figure 10:
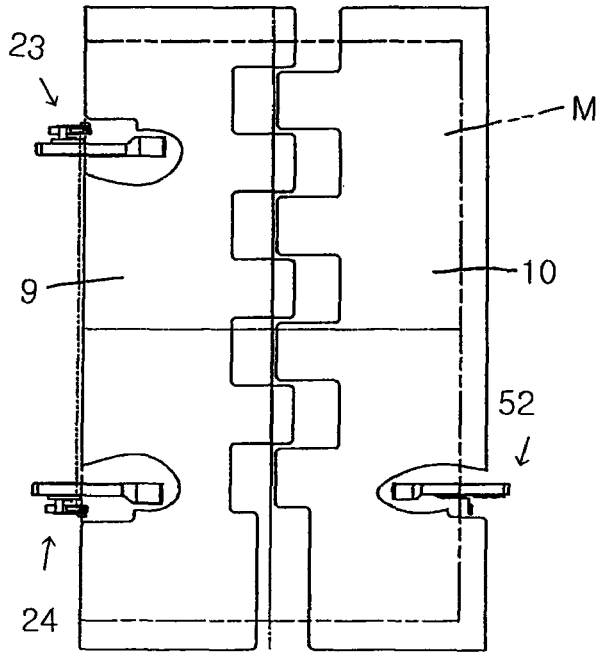
FIG. 10 shows an illustrative view of one embodiment of the table mechanism of FIG. 7.

Based on the results of the measurement, the computer calculates the distance of movement required for the center line in the lateral direction of the plate material M to agree with the targeted center line, and sends a signal to the electrically driven actuators 27, 28, of the first means of traction 25, whereby the electrically driven actuators 27, 28, contract so that the center line in the lateral direction of the plate material M agrees with the targeted center line, as shown in FIG. 10.

The distance by which the plate material M is to be moved so that the center line in the lateral direction of the plate material M agrees with the targeted center line can be calculated according to the following procedures. Namely, as shown in FIG. 7, the width d of the plate material M is calculated as follows:

The distance b is obtained. It is the distance between the edge of the left-hand side of the left plate 9 when the two plates., i.e., the left and right plates 9, 10, come closer to each other and the center of the photosensor 29 of the first measuring means 23 when the first measuring means 23 returns to the left when the two plates, i.e., the left and right plates 9, 10, approach each other. The distance c is obtained. It is the distance between the edge of the right-hand side of the right plate 10, and the end of the photosensor 31 of the third measuring means 52. Then the distance a is obtained by adding the predetermined value T to b and c.

Then, based on the results as measured by the first measuring means 23 through the third measuring means 52, the distance e is calculated. It is the distance between the edge of the left-hand side of the plate material M in the lateral direction and the center of the photosensor 29 of the first measuring means 23. The distance f is calculated. It is the distance between the edge on the right-hand side of the plate material M in the lateral direction and the end of the photosensor 31 of the third measuring means 52. Then the distance d, which is the width of the plate material M in the lateral direction, is calculated by subtracting the distances e and f from the distance a.

Then distance h, which is the distance between the center line in the lateral direction of the plate material M and the center of the photosensor 29, is obtained by adding half the length d of the plate material M to the distance e. Finally the distance of the movement is obtained by subtracting the distance h from the distance g, which is the distance between the center of the photosensor 29 and the center line in the lateral direction of the plate material M.

Figure 11:
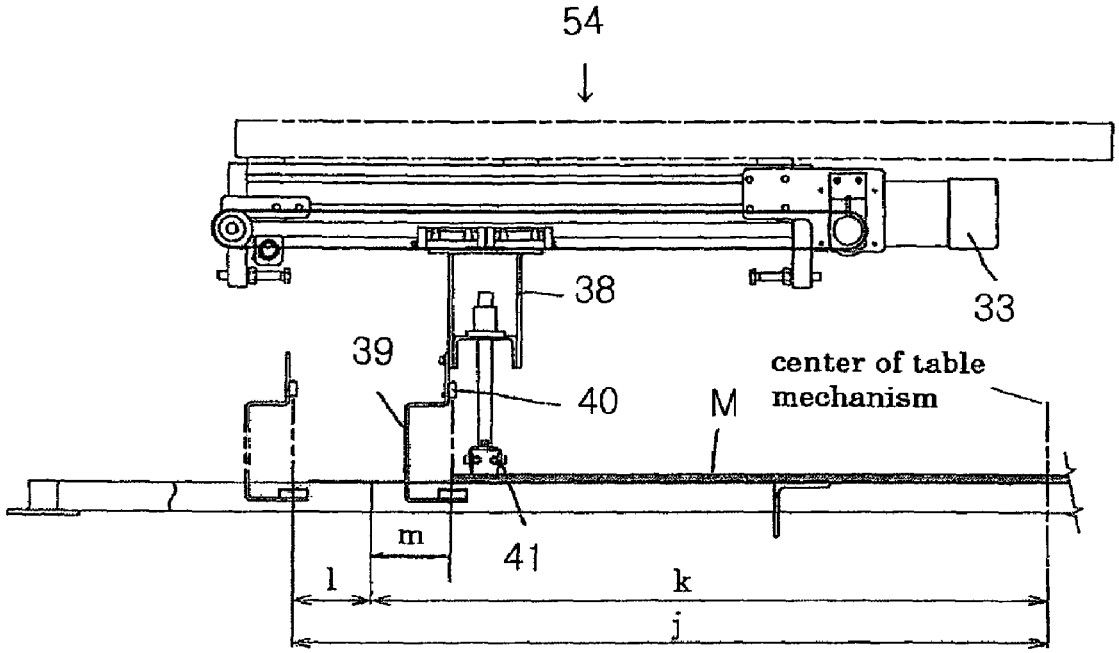
FIG. 11 shows an illustrative view of one embodiment of the fourth measuring means of FIG. 6.

After the center line in the lateral direction of the plate material M is matched with the targeted center line, the clamping of the plate material M by the clamp means 26 is released. Then the first measuring means 23 and the clamping means 26, etc., are returned to the left-hand side by the operation of the electrically driven actuators 27, 28. Then the second adjusting means 7 is lowered via the hoisting frame 53 by the electric motor 44 of the second adjusting means 7 being reversely rotated and, as shown in FIG. 11, a bracket 39, a photosensor 40, etc., of the fourth measuring means 54, are moved toward the end in the longitudinal direction of the plate material M for which the deviation in the lateral direction has been adjusted. Then the position of the fourth point of an arbitrary choice on the edge of the short side of the plate material M is detected by the fourth measuring means 54, and the computer calculates the value by which the deviation is adjusted in the longitudinal direction of the plate material M. That is, as shown in FIG. 11, the distance 1 is obtained by subtracting the distance k, which is half the size (length) in the longitudinal direction of the plate material M, from the distance j, which is the distance from the center of the table mechanism 5 to the end point where the travel frame 38 runs farthest.

Next, as shown in FIG. 11, the portion near the end in the longitudinal direction of the plate material M is clamped after the holding member 41 is lowered. Then the traveling frame 38 is moved forward by the length m by the electric motor 33 with the decelerator of the fourth measuring means 54 being rotated in a positive direction and pulls the plate material M, whereby the distance between the center of the table mechanism 5 and the center of the photosensor 40 is adjusted to the distance k. Then the deviation in the longitudinal direction of the plate material M is adjusted. This completes the adjustment of the deviation of the plate material M. After the completion of the adjustment of the deviation of the plate material M, the holding by the holding member 41 of the plate material M is released by the holding member 41 being lifted, followed by the traveling frame 38 being returned to the initial position (at the position of the left-end starting point of the length j) by the electric motor 33 being rotated in the positive direction. Next the clamping means 43 is lowered via the hoisting frame 53 by the electric motor 44 being reversely rotated and then it clamps the plate material M for which the deviation has been adjusted. Then the plate material M is lifted to the delivery means 4 via the clamping means 43 by the electric motor 44 being rotated in the positive direction, followed by the plate material M being clamped by the clamping means 59, 59 after having the two frames, i.e., the left-hand side and right-hand side frames 57, 58, of the delivery means 4 approach each other.

In the above examples the table mechanism 5 is described as comprising the two plates, i.e., the left, and right plates 9, 10, that can approach and draw apart from each other. However, the table mechanism 5 can comprise structures other than the two plates as shown in the examples, for example, a table that can be reeled and rewound, a plate that can be divided into four or more parts, the forward, backward, left, and right plate members, etc.

The basic Japanese Patent Application, No. JP2008-009964, filed Jan. 21, 2008, is hereby incorporated in its entirety by reference in the present application.

The present invention will become more fully understood from the detailed description of this specification. However, the detailed description and the specific embodiment illustrate desired embodiments of the present invention and are described only for the purpose of explanation. Various changes and modifications will be apparent to those of ordinary skill in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as") provided herein, is intended merely to better illuminate the invention and does not pose a limitation on the scope of the invention unless otherwise claimed.

The invention claimed is:

1. A method of adjusting the deviations of plate material of a rectangular shape, which method adjusts at one location the deviations of the inclination, positioning, etc., from the desired state of the plate material that is arbitrarily placed in a horizontal position before the plate material is delivered to the forming machine, the method comprising:

measuring each of the positions of the first and second points of an arbitrary choice on the edge of one of the long sides of the plate material;

adjusting the deviation of the inclination of the plate material by rotating it on the horizontal plane so as to remove the difference in the positions of the plate material in the lateral direction between the first and second points, based on the results of the measurements of the first and second points;

measuring the position of a third point of an arbitrary choice on the edge of the second or opposite long side of the plate material for which the deviation of the inclination has been adjusted;

calculating the position of the center line extending in the lateral direction of the plate material for which the deviation of the inclination has been adjusted, based on the results of the measurements of the positions of the first, second, and third points;

adjusting the deviation of the positions in the lateral direction by moving the plate material in the lateral direction and substantially matching the center line extending in the lateral direction of the plate material with the targeted center line;

measuring a fourth point of an arbitrary choice on the edge of the short side of the plate material for which the deviation of the plate material in the lateral direction has been adjusted;

calculating the position of the center line of the plate material extending in the longitudinal direction, based on the results of the measurements of the position of the fourth point; and adjusting the deviation in the longitudinal direction of the plate material by moving the plate material in the longitudinal direction and substantially matching the center line extending in the longitudinal direction of the plate material with the targeted center line, based on the results of the calculation of the position of the center line extending in the longitudinal direction.

2. The method of adjusting the deviations of the plate material of a rectangular shape of claim 1, wherein the long sides and the short sides of the plate material have substantially the same lengths or have lengths such that the comparative lengths of the long side and the short side of the plate material are reversed.

3. Equipment that is arranged to adjust at one location deviations in inclination, positioning, etc., from a desired state, of plate material of a rectangular shape that is arbitrarily placed in a horizontal position, comprising:

a table mechanism on which the plate material is placed and through which the plate material can be lifted and lowered;

a first adjusting means attached to the table mechanism, which means is arranged to adjust the deviation in the lateral direction of the plate material that is placed on the table mechanism;

a second adjusting means that is disposed above the first adjusting means and that can be lifted and lowered, and that is arranged to adjust the deviation in the longitudinal direction of the plate material for which the deviation in the lateral direction has been adjusted; and a hoisting mechanism that lifts and lowers the second adjusting means, wherein the first adjusting means comprises:

a first measuring means and a second measuring means that measure respectively the positions of a first and a second point of an arbitrary choice on the edge of one of the long sides of the plate material;

a first calculating means that calculates the difference in the positions between the first and second points in the lateral direction of the plate material, based on the result of measurements of the positions of the first and second points;

a first means of traction that pulls the plate material, based on the result of the calculation of the first calculating means;

a third measuring means that measures a third point of an arbitrary choice on the edge of the second or opposite long side of the plate material;

a second calculating means that calculates the position of the center line extending in the lateral direction of the plate material for which the deviation of the inclination has been adjusted, based on the results of the measurements of the positions of the first, second, and third points; and the second adjusting means comprises:

a fourth measuring means that measures the position of a fourth point of an arbitrary choice on the edge of one of the short sides of the plate material for which the deviation in the lateral direction has been adjusted;

a third calculating means that calculates the position of the center line of the plate material extending in the longitudinal direction, based on the result of the measurement of the position of the fourth point; and a second means of traction that pulls the position of the center line of the plate material extending in the longitudinal direction to the position of the targeted center line, based on the result of the calculation carried out by the third calculating means.

* * * * *